US005358175A

United States Patent [19]

Cai

[11] Patent Number: 5,358,175

[45] Date of Patent: Oct. 25, 1994

[54] CUP CONTAINER WITH INTERGRAL CLOSURE

[75] Inventor: Liming Cai, West Chester, Pa.

[73] Assignee: Dopaco, Inc., Downingtown, Pa.

[21] Appl. No.: 33,475

[22] Filed: Mar. 17, 1993

[51] Int. Cl.[5] ..... B65D 5/06; B65D 5/46

[52] U.S. Cl. ..... 229/117.14; 229/104; 229/106; 229/117.26; 229/128; 229/155; 229/911

[58] Field of Search ..... 229/104, 106, 117.14, 229/117.23, 117.26, 128, 138, 155, 910, 911

[56] References Cited

U.S. PATENT DOCUMENTS

| | | | |
|---|---|---|---|
| D. 306,975 | 4/1990 | Brondyke et al. . | |
| 396,570 | 1/1889 | Hotchkiss | 229/911 |
| 886,058 | 4/1908 | Hollett | 229/911 |
| 906,485 | 12/1908 | Bloomer | 229/911 |
| 1,065,917 | 7/1913 | Butler . | |
| 1,104,392 | 1/1914 | Stone | 229/117.26 |
| 1,492,100 | 4/1924 | Krueger | 229/117.26 |
| 1,914,239 | 3/1931 | Boder . | |
| 2,004,818 | 5/1933 | Luckett . | |
| 2,341,762 | 2/1944 | Conklin | 229/117.14 |
| 2,355,729 | 8/1944 | Inman | 229/117.14 |
| 2,355,730 | 8/1944 | Inman | 229/911 |
| 2,661,138 | 12/1953 | Leonard | 229/106 |
| 2,687,840 | 8/1954 | Innes | 229/106 |
| 2,731,189 | 5/1956 | Moore . | |
| 2,903,180 | 9/1959 | Holmes | 229/117.14 |
| 2,961,145 | 11/1960 | Ellison | 229/117.14 |
| 3,680,771 | 8/1972 | Blunsdon | 229/106 |
| 4,714,164 | 12/1987 | Bachner . | |
| 4,730,766 | 3/1988 | Fear . | |
| 4,850,528 | 7/1989 | Hanus . | |
| 5,139,196 | 8/1992 | Fry et al. . | |

OTHER PUBLICATIONS

Imperial Bondware, 2 page advertisement, Copyright 1990.

*Primary Examiner*—Gary E. Elkins

*Attorney, Agent, or Firm*—Dennison, Meserole, Pollack & Scheiner

[57] ABSTRACT

A container formed of foldable sheet material including a body of a slightly tapered inverted conical configuration having opposed pairs of closure flaps integrally hinged to the upper rim of the body and foldable to overlie the upwardly directed open mouth of the container. The inward folding of the flaps inwardly flex corresponding portions of the body wall to a generally rectangular configuration adjacent and downward from the rim. The outer flaps interlock by a cooperating tongue and slot. In variations, integral or bonded handles are provided to overlie the closed container. Additional sealing at the defined corners between adjacent flaps is achieved by integrally formed folding gussets.

12 Claims, 4 Drawing Sheets

CUP CONTAINER WITH INTERGRAL CLOSURE

BACKGROUND OF THE INVENTION

Cup containers of paperboard or a similar stiff foldable sheet material are conventionally of an inverted truncated conical configuration which tapers slightly from a smaller diameter sealed base to a larger diameter open mouth and is of a circular cross section throughout the height thereof.

Such a cup construction is easily and economically formed from a blank, is readily adaptable for nested stacking for shipping and storage purposes, and is of sufficient inherent rigidity for most purposes.

While attempts have been made to provide tapered cups with integral closures, the most common closure in actual use is a separate circular lid which overlies the open upper end of the cup and snap-locks to the rolled rim thereof.

Further, while the tapered configuration of the conventional cup facilitates the filling of the cup, as well as the removal of the contents, the circular tapered configuration requires the provision of substantial storage space for filled cups, for example within a carrier.

Another form of known container is the rather flimsy substantially rectangular container normally associated with take out foods, such containers having flap closed bottoms and tops, and small wire handles.

SUMMARY OF THE INVENTION

It is a principal purpose of the present invention to improve upon fast food containers, of the type frequently associated with Chinese take out foods, by the utilization of a specifically modified cup construction. The cup construction includes the inherent advantages of manufacturing economies and strength of a cup, and additionally incorporates unique improvements, including an integral closure, which particularly adapt the container for a wide variety of foodstuffs including liquids.

The container of the invention is basically in the shape of a tapered conical cup with a sealed bottom, and with an upper rim defined by fold lines between the body or peripheral wall of the cup and four closure flaps oriented in two cooperating pairs of flaps at right angles to each other. The flaps, in the open container, generally follow the upright taper of the cup and the arc of the upper rim, and form an empty unit particularly adapted for nested stacking.

Upon a closing of the closure flaps, the rim area of the cup inwardly deforms into a substantially rectangular configuration which gradually tapers downwardly to the circular base and provides generally vertical and planar wall faces for side-by-side positioning of the filled containers.

The integral closure flaps, in addition to providing an appropriate closure for the container, upon being closed and converting the upper portion of the container to a rectangular configuration, also substantially strengthen the container.

The actual locking of the closure flaps is effected by the upper pair of flaps which include an elongate slot and a headed tongue with a laterally directed locking notch which engages through the slot. In addition, and depending upon the nature of the foodstuff to be received within the container, integral sealing webs or gussets can be provided between adjacent flaps to fold within and more completely seal the corner junctures between the closed flaps about the periphery of the rim.

The invention also contemplates the provision of handles on the container which can either be integrally formed as a part of the flap closure structure, or as additional elements of the same sheet material as the container and bonded thereto as the basic blank is formed. In each form, the handles, upon a closing of the container, can be conveniently folded into operative position.

The objects of the invention include the provision of a cup container which is particularly adapted for use much in the manner of the paperboard buckets with wire handles commonly associated with take out "Chinese" foods, and which at the same time is equally adapted for use either as a box or cup for substantially any type of foodstuffs. Depending upon the insulative and moisture proof nature of the paperboard material, the container can be used for soup or other liquid products, warm foods, cold foods, dry foods, and the like.

Another significant object of the invention is to provide a container for carry out food and the like which includes a handle formed of the same paperboard material as the body of the container, thereby eliminating the more conventional wire handle which in turn simplifies and reduces the expense of construction of the container. Further, by elimination of the metal component, the handle, the container can be introduced directly into a microwave oven for a heating of the contents, and is a more ecologically acceptable product.

Other objects, features and advantages of the invention will become apparent from the more detailed description of the invention following hereinafter.

DESCRIPTION OF PREFERRED EMBODIMENTS

Figure 1:
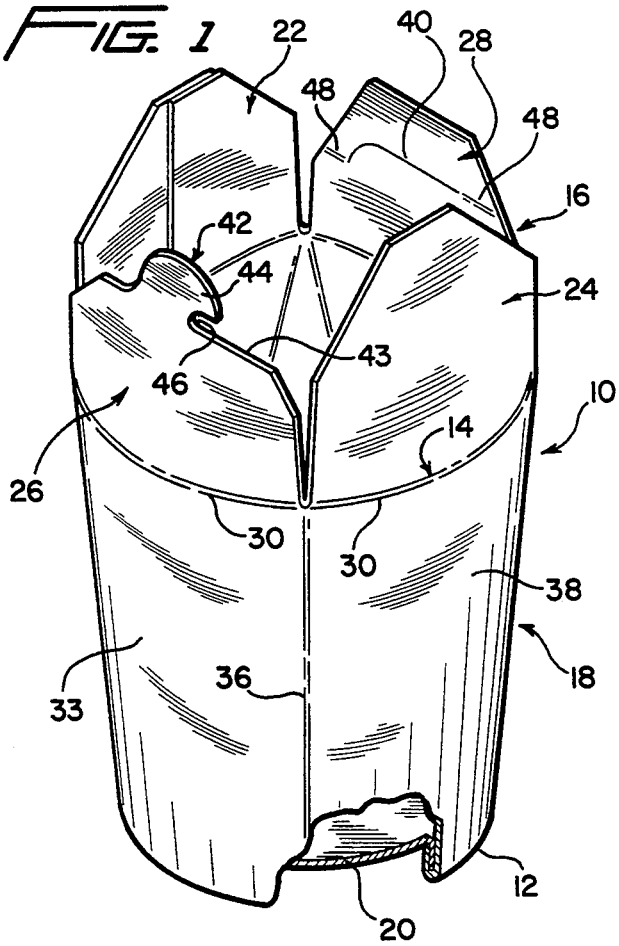
FIG. 1 is a perspective view of an open container in accord with the present invention and with a portion broken away to illustrate the bottom construction.
Figure 2:
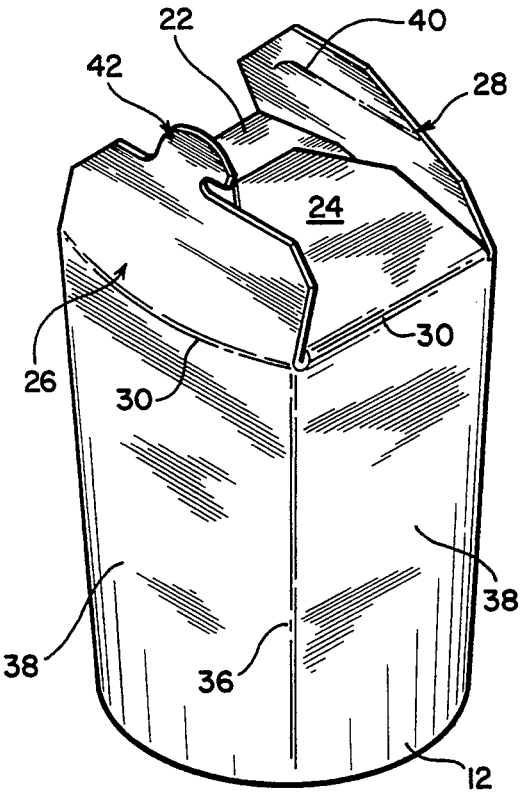
FIG. 2 is a perspective view with the closure flaps partially closed.
Figure 3:
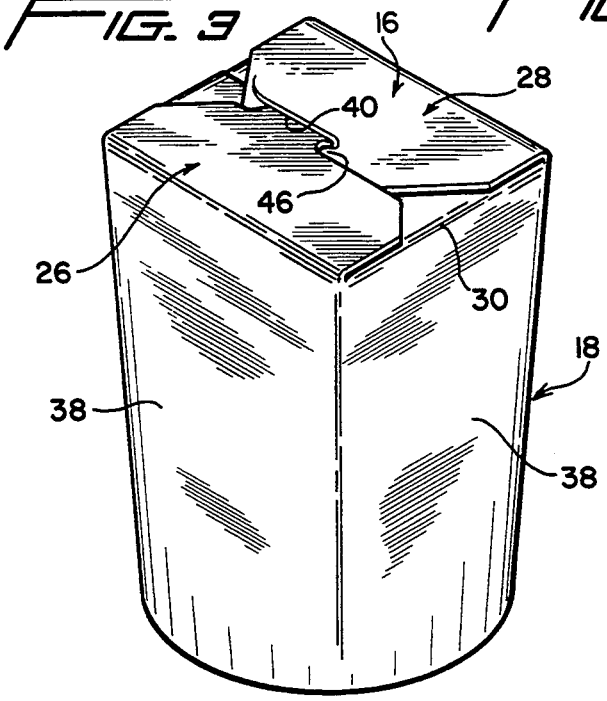
FIG. 3 is a perspective view with the closure flaps fully closed and locked.

The container 10 is, in the manner of a cup, of an inverted generally frusto conical configuration, tapering slightly outward from a circular base 12 to a generally circular rim 14 from which a multiple flap closure assembly 16 integrally and upwardly projects.

The body 18 of the container, that is the peripheral wall between the base 12 and the rim 14, is formed by rolling a sheet of appropriate stiff foldable material, preferably paperboard or the like, and bonding the edges thereof along a generally vertical seam. The base 12 is conventionally formed of a flanged base panel 20 with the lower edge of the body wall inwardly rolled about and bonded to the base panel flange.

The closure flap assembly 16 comprises a pair of opposed inner closure flaps 22 and 24, and a pair of opposed outer closure locking flaps 26 and 28 at right angles to the inner flaps. Each of the flaps in the opposed pairs is integral with the body 18 at the rim and foldable relative thereto about respective fold lines 30 which define the rim 14.

Figure 6:
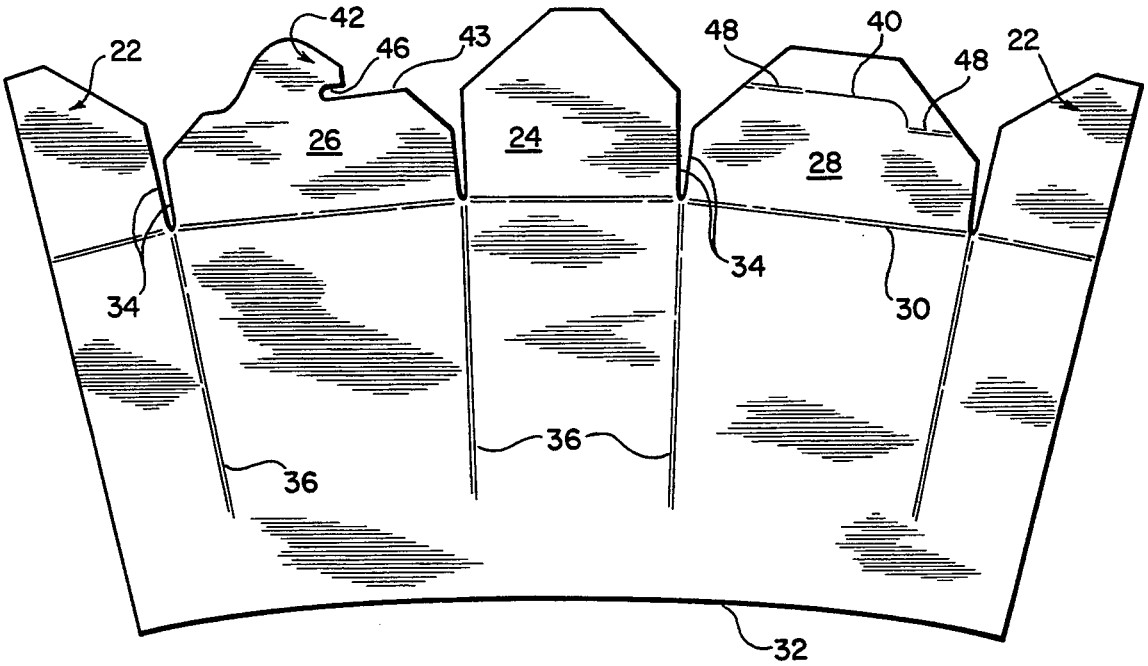
FIG. 6 is a plan view of the blank from which the container is formed.

Noting the blank of FIG. 6 from which the container 10 is formed, the flap fold lines 30, while following a generally arcuate curvature similar to that of the base edge 32 of the blank so as to provide the desired cup-like configuration for the folded container 10, are individually straight. The opposed side edges 34 of each of the closure flaps 22, 24, 26 and 28 are approximately perpendicular to the respective fold lines 30. The adjacent side edges 34, between adjacent flaps, are slightly separated from each other to form a corner-defining space and allow for a free inward folding of the inner flaps 22 and 24 between the outer flaps 26 and 28, after which the outer flaps are also inwardly folded. As desired, and for ease of folding, the outer edge of the flaps may have beveled corner portions.

Upon a forming of the blank into the generally conical configuration of the container body 10, the straight fold lines 30 which define the rim 14 assume an arcuate configuration which in turn defines a slightly flattened but basically substantially circular rim 14 whereby a substantially circular cross section is maintained throughout the height of the container body 18 between the circular base 12 and the rim 14.

The peripheral wall which defines the conical body 18 of the container 10 includes linear crease lines 36 therein, one aligned between each pair of adjacent flaps and commencing at the corresponding fold line 30 and extending downward therefrom for approximately three quarters of the height of the body 18.

Figure 4:
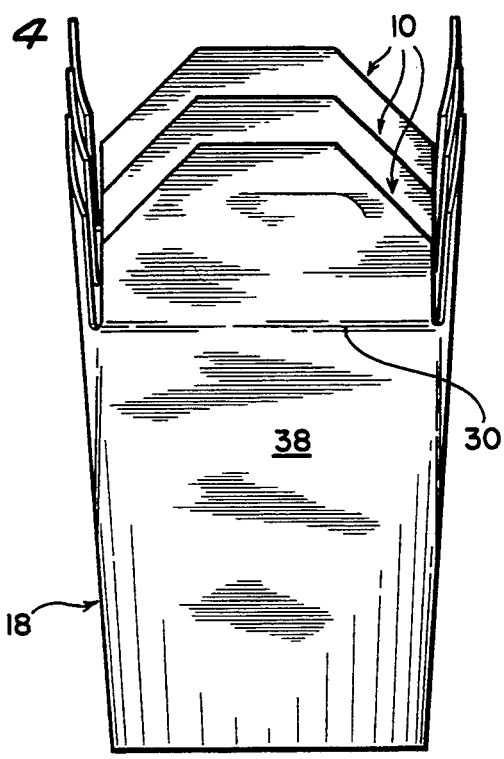
FIG. 4 is an elevational view illustrating the nesting of the empty containers.

Each pair of crease lines 36 defines a panel 38 therebetween vertically aligned below the corresponding closure flap and the fold line 30 thereof. In the open container 10 of FIG. 1, these panels also initially form a slightly flattened arc which maintains the desired generally cylindrical configuration and circular cross section of the container which in turn facilitates both the introduction and removal of foodstuffs, and which, with the empty containers prior to use, provide for a compact nested stacking as suggested in FIG. 4.

After a filling of the container, it is desirable to both close and seal the container for protection of the contents, and to compactly configure the container for use as a "carry out" container packed and or stacked with similar containers within a carrier, bag or the like. Both the closing and sealing of the container, and the compact configuring of the container occur simultaneously. In other words, as the closure assembly 16 is closed, the body of the container assumes the desired configuration.

More specifically, when the container 10 is to be closed, the opposed inner closure flaps 22 and 24, which may have slightly tapered upper outer ends, are inwardly folded about the respective fold lines 30 to horizontally overlie the open mouth of the container. The inner flaps 22 and 24 slightly overlap each other as illustrated to provide a stabilizing effect. Upon inwardly folding the inner flaps 22 and 24, the corresponding fold lines 30 assume a straight configuration and the associated wall panels 38 inwardly deform, with the inward deformation being greatest upward toward the corresponding fold lines 30, and assume a substantially planar configuration. This planar configuring of the panels 38 is encouraged and guided by crease lines 36.

Figure 5:
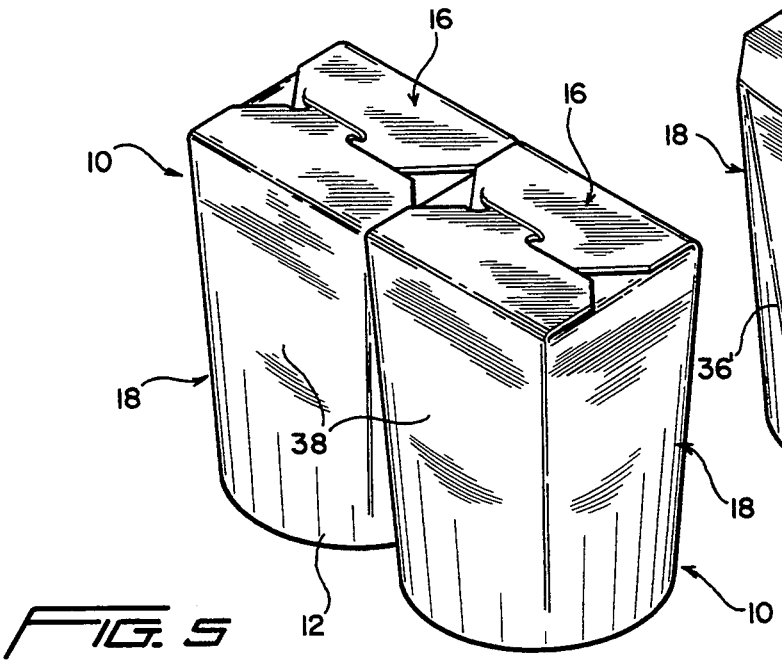
FIG. 5 illustrates an adjacent positioning of two closed containers.

The outer or locking closure flaps 26 and 28 are inwardly folded to a horizontal position overlying the inner flaps 22 and 24. In doing so, the corresponding fold lines 30 straighten and the associated wall panels 38 correspondingly inwardly flex with the resultant closed container having a circular base and a rectangular top with the sides of the container body tending to present generally vertical planar faces for a major portion of the height thereof for a compact side-by-side packaging of the closed containers as suggested in FIG. 5.

The closure assembly 16 is releasably locked in its closed position by a slot 40 defined transversely across the upper portion of outer flap 28 and including a linear extent and a slightly downward curving end portion, and a cooperating tongue 42 integrally projecting from the upper edge 43 of the opposite locking flap 26. The tongue 42 includes a laterally directed head 44 with a retaining recess 46 defined between the head and the upper edge 43 of the flap 26. The opposed ends of the slot 40, laterally offset because of the downwardly curved end portion thereof, provide for or enable a flexing of the outer end portion of the flap 28 along parallel offset lines, which may be defined by fold facilitating crease lines 48, extending from the opposite ends of the slot 40 to the corresponding side edge portions of the flap 28. This offset of the lines for the outer end portion of the flap 28 provides for a slight opening of the slot 40 in a manner which greatly simplifies the insertion of the tongue 42.

The tongue recess 46, upon an engagement of the tongue 42 within the slot 40, opens toward the straight end of the slot 40 with the tongue, for engagement within the slot, being so aligned whereby a slight lateral flexing of the tongue flap 26 toward the curved end of the slot 40 is necessary for introduction of the tongue through the slot. Once engaged through the slot, the inherent flexible resiliency of the material of the container automatically returns the tongue and tongue flap from its laterally shifted engaging position whereby the projecting head 44 of the tongue extends beyond the straight end of the slot 40 to lock the tongue 42 within the slot 40. Disengagement of the tongue from the slot merely requires a similar lateral flexing of the tongue to align the head portion thereof with slot 40 for withdrawal. As will be recognized, the formation of the slot 40 with a single curved end portion, and the resultant slot-opening folding of the outer end portion of the corresponding flap 28 on laterally spaced lines to the opposite ends of the slot provide for a minimal weakening affect transversely of the slotted flap 28 while greatly facilitating engagement and disengagement of the tongue and the provision of a positive interlock.

As will be appreciated, the rectangular configuration of the upper end of the closed container 10 may be square by making all of the flaps of equal width, or elongate, as illustrated, by providing for the inner flaps 22 and 24 as being slightly narrower than the outer flaps 26 and 28. The rectangular configuration of the upper end of the container 10 is additionally significant in providing for a substantial rigidification of the container which, in conjunction with the base construction, provides an extremely stable container, notwithstanding the foldable nature of the conventional paperboard or the like sheet material used. The stability of the upper end of the closed container is further enhanced by the opposed longitudinal edges 34 of the closed inner flaps 22 and 24 which define bearing edges for the sidewall panels associated with the outer locking flaps 26 and 28 which, at the corresponding fold lines 30, are brought into engagement therewith upon an inward folding of the locking flaps 26 and 28. This engagement is retained by the interlocking of the tongue 42 and tongue slot 40 which retains the outer flaps horizontally engaged over the inner flaps.

For convenience in forming the blank into the container 10, and as suggested in the drawings, the overlapping bonded edges thereof define a seam extending upward along the body centrally aligned with one of the inner flaps 22.

Figure 7:
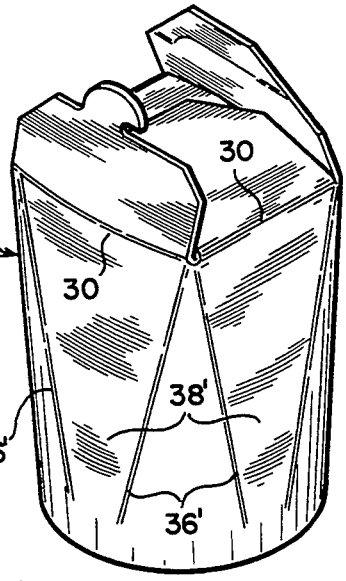
FIG. 7 is a perspective view similar to FIG. 2 with a modified form of crease lines provided on the container wall.

Noting FIG. 7, as a variation the peripheral wall which defines the conical body 18 of the container may be formed with a pair of downwardly diverging crease lines 36' between adjacent flaps, rather than the single crease lines 36 previously described. This in turn provides a pair of converging crease lines 36' associated with each closure flap and extending downward from the corresponding fold line 30 for approximately three-quarters of the height of the body 18. The corresponding lower ends of each of these pairs of converging crease lines 36' terminate in aligned spaced relation to each other.

Each pair of converging crease lines 36' defines a generally inverted triangular panel 38' therebetween vertically aligned below the corresponding closure flap and the fold line 30 thereof. Upon folding of the closure flaps, the panels 38' inwardly deform toward a planar configuration of more limited area than that achieved by the first described crease lines 36. The resultant container configuration, while to a degree providing the desired rectangular shape, does so only at the upper portion of the closed container, rather than for substantially the full height thereof.

Figure 8:
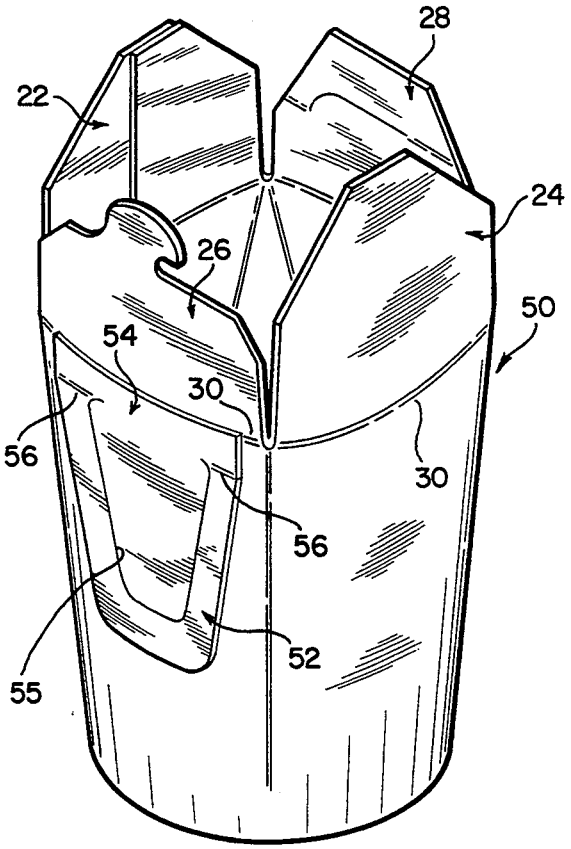
FIG. 8 is a perspective view of a second embodiment with a pair of opposed handles bonded thereto.
Figure 9:
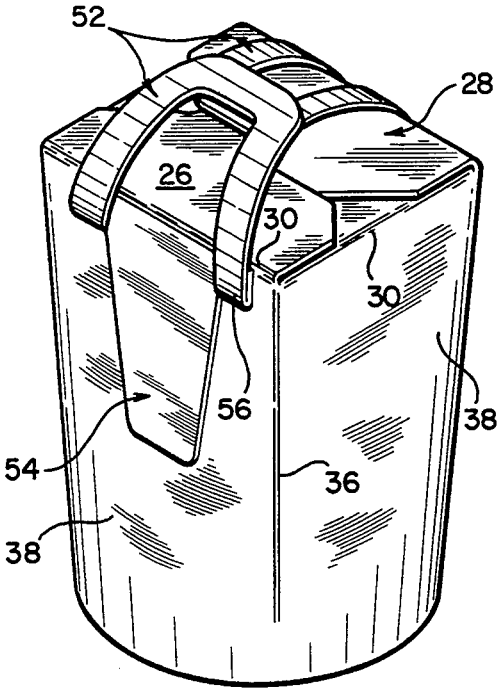
FIG. 9 is a perspective view of the embodiment of FIG. 8 with the closure flaps closed and the handles in carrying position.

Referring to FIGS. 8 and 9, a second container embodiment 50 is illustrated therein.

Figure 10:
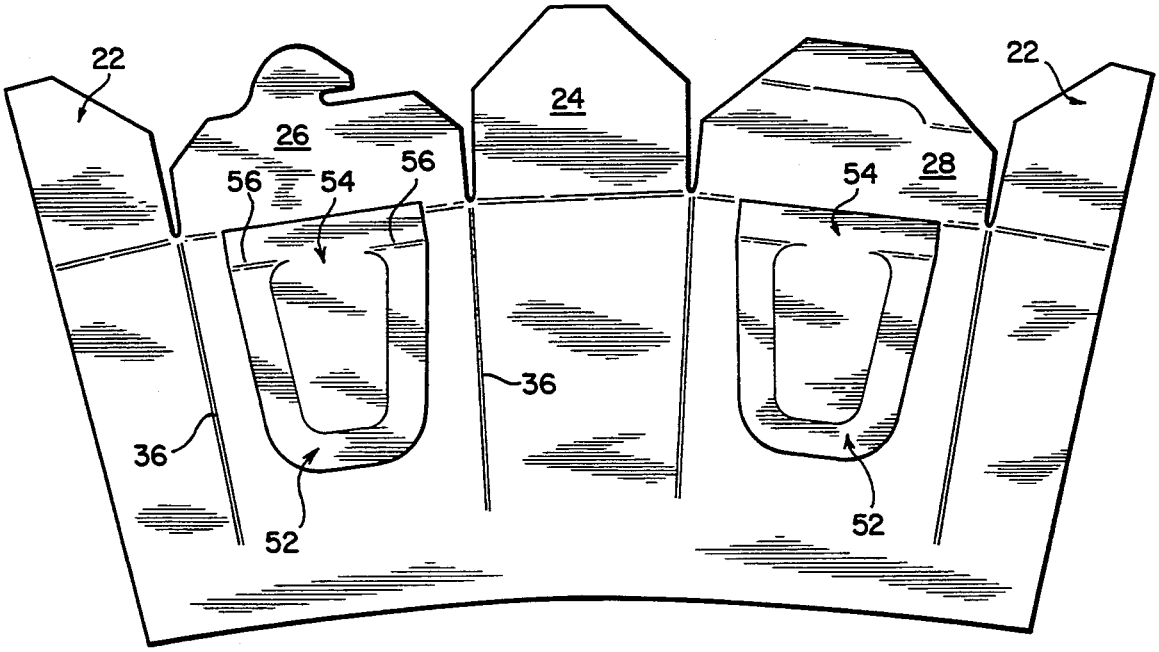
FIG. 10 is a plan view of the blank from which the embodiment of FIG. 8 is formed.

The container 50 is quite similar to the container 10, differing therefrom in including a pair of opposed loop handles 52. Each loop handle 52 is formed from a handle panel 54 bonded to the opposed wall portions 38 aligned with the outer flaps 26 and 28 immediately below the corresponding upper rim fold lines 30. The handle defining portion of each handle panel is separated from the remainder of the handle panel by a U-shaped cutline 55 and, as opposed to the remainder of the handle panel 54, is not bonded to the underlying wall portion. The opposed inner ends 56 of each loop handle 52 are on a common line immediately below the rim and hinged to the corresponding handle panel 54 on integral fold lines with the loop handle 52 laying against the body of the container therebelow. As noted in FIG. 9, after a closing of the container 50 as described in connection with container 10, the two opposed loop handles 52 are upwardly pivoted about the fold lines at the inner ends 56 thereof to join centrally over the closed top of the container for easy carrying. It will be recognized that the handles 52, prior to upward rotation into the carrying position, are downwardly directed relative to the top of the container and .lie against the wall of the container in the plane of the corresponding handle panels 54 to provide substantially no projection, and minimal interruption to the smooth exterior of the container so as to not affect the stacking capability thereof. The blank from which the container 50 is formed is illustrated in FIG. 10.

Figure 11:
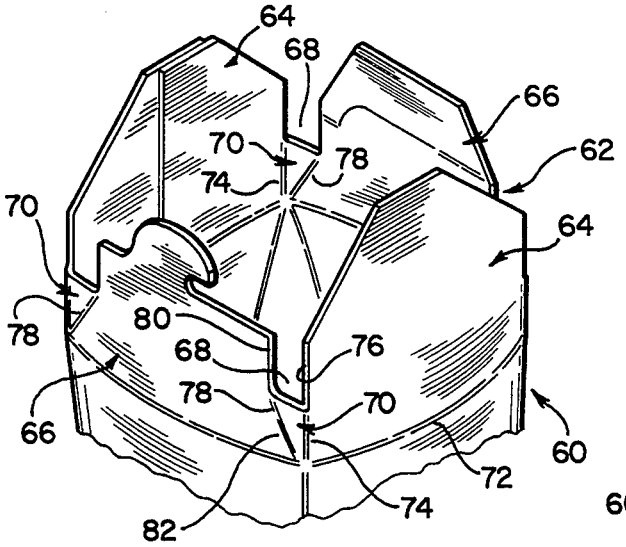
FIG. 11 is a perspective view of the upper portion of the container illustrating a further variation in the closure assembly including sealing gussets.
Figure 12:
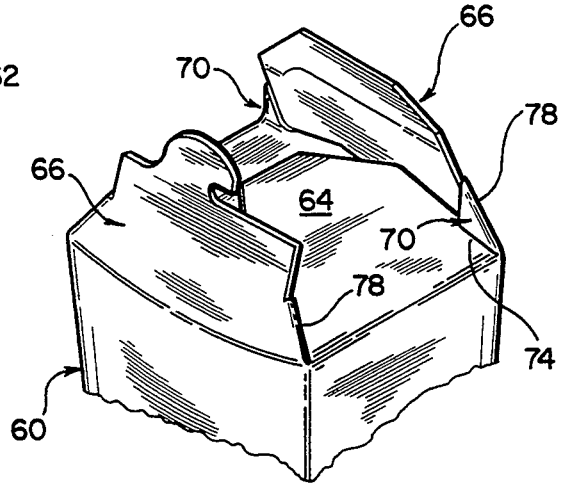
FIG. 12 is a perspective view of the upper portion of the variation of FIG. 11 wherein the closure flaps are partially folded to their closed position.

FIGS. 11 and 12 illustrate container 60 which is a third embodiment of the invention wherein the closure assembly 62, while similar to the closure assemblies of containers 10 and 50, is slightly modified to provide for an enhanced sealing of the contents to minimize leakage at the upper corners should the container be accidently overturned or otherwise mishandled.

More specifically, the closure assembly 62 of the container 60 includes opposed inwardly folding inner flaps 64, and opposed inwardly folding overlying outer flaps 66 with an interlocking tongue and groove, all as described with the closure assembly 16 associated with the container 10 of FIG. 1.

The closure assembly 62 basically differs from the initially described closure assembly 16 in that the outer flaps 66 are slightly narrower than the corresponding outer flaps 26, 28 of container 10 whereby the lateral space, generally indicated at 68, between the adjacent side edges of adjacent flaps is relatively wider than in the first described embodiment.

In addition, and most significantly, an integral sealing web or gusset 70 is formed within each edge space 68 upwardly from the peripheral fold line 72 which defines the container rim and about which the flaps 64 and 66 fold. Each gusset 70 includes a first upwardly directed fold line 74 extending upward from the rim fold line 72 co-linear with the side edge 76 of an adjacent inner flap 64, and a second diagonal fold line 78 which extends at an angle from the meeting point of the fold line 74 and rim fold line 72 to the adjacent side edge 80 of the adjacent outer flap 66. As will be recognized, the diagonal fold line 78 defines a corresponding triangular extension 82 at the corresponding lower corner of the outer flap 66. Each gusset 70 is of a height, along fold line 74, substantially equal to its width, that is the distance between the side edges 76 and 80 of the adjacent inner and outer flaps 64 and 66 at each corner thereof. Formed in this manner, and noting the perspective detail of FIG. 12, as an inner flap 64 is inwardly folded, the gussets to the opposite edges thereof fold inwardly about the fold lines 74 and 78. This is followed by an inward folding of the outer flaps 66 which inverts the gussets, which continue to bend about the fold lines 74 and 78, to overlie the inner flaps, underlie the outer flaps and completely seal the corresponding corners between the inner and outer flaps to avoid any apertures thereat and any leakage therethrough.

Figure 13:
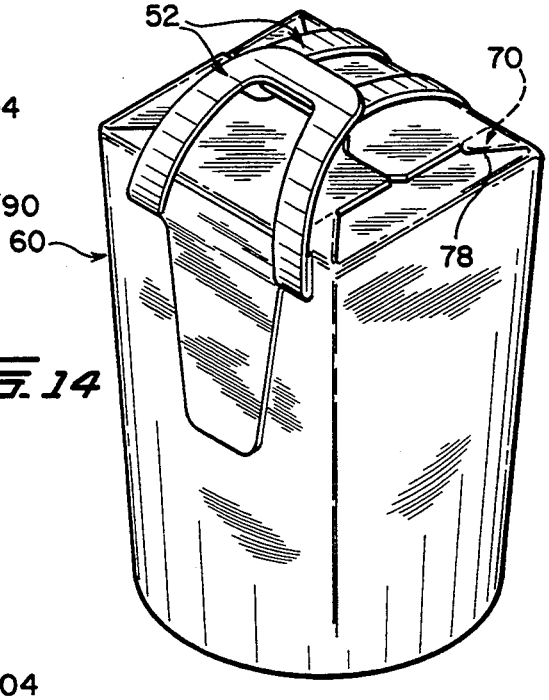
FIG. 13 is a perspective view of an embodiment including the handles of FIG. 8 and the sealing gussets of FIG. 11.

As suggested in FIG. 13, container 60 can also incorporate loop handles of the type utilized in conjunction with the container 50.

Figure 14:
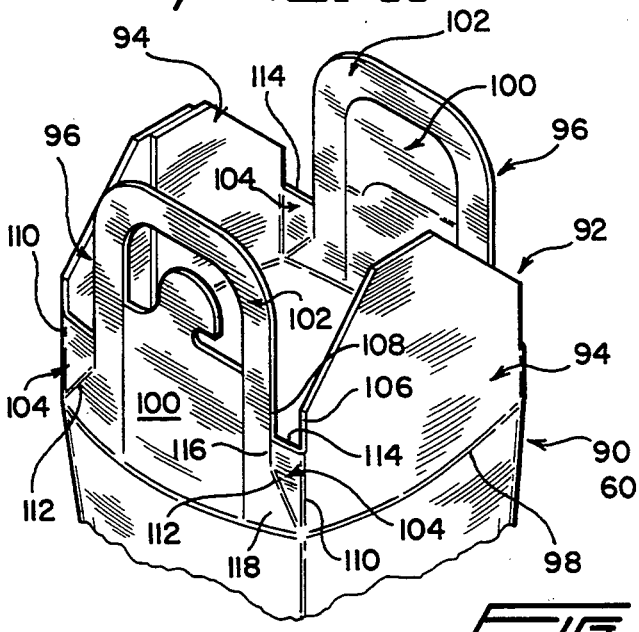
FIG. 14 illustrates a further variation wherein the closure assembly includes integral handles.
Figure 15:
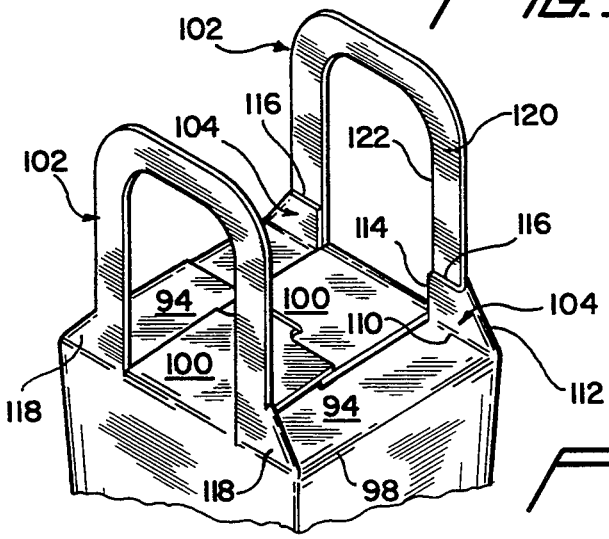
FIG. 15 is a perspective view with the closure assembly of FIG. 14 closed and the handles positioned for grasping.

A fourth embodiment of the container of the invention is illustrated in FIGS. 14 and 15 and designated by reference numeral 90. The container 90 differs from the previously described containers principally in the construction of the closure assembly 92.

Similar to the other embodiments, the closure assembly 92 includes a pair of opposed inner flaps 94 and a pair of opposed flap panels 96 at right angles thereto. The inner flaps 94 and flap panels 96 extend upwardly from a peripheral rim-defining fold line 98 about the container body.

Each flap panel 96 has an outer flap 100 defined therefrom and inwardly foldable into tongue and slot interlocking engagement with the opposed outer flap 100 about the integral rim fold line 98, much in the manner of the previously referred to outer flaps.

Each outer flap 100 is in turn encircled, about the free folding portion thereof outward of the fold line 98, by an upwardly projecting loop handle 102. The lower ends of the loop handle are also integral with the container body at the fold line 98 for inward flexing or folding thereof subsequent to a closure of the flaps for a grasping and lifting of the container in one hand.

In order to both effect a positive seal at the top corners defined by the inwardly folded inner and outer flaps 94 and 100, and at the same time brace and stabilize the upwardly directed handle loops 102, a folding gusset 104 is integrally defined between the adjacent side edges 106 and 108 respectively of adjacent inner and outer flaps at the four corner areas defined about the container. Each gusset 104 includes a fold line 110 extending upwardly from the rim-defining fold line 98 co-linear with the corresponding side edge 106 of the corresponding inner flaps 94. A second diagonal fold line 112 extends from the meeting point of the rim fold line 98 and gusset fold line 110 at an upward inclination terminating at the adjacent side edge 108 of the adjacent flap panel 96, which actually constitutes the corresponding outer edge of the associated loop handle 102. The fold line 112 meets the edge 108 below the generally horizonal upper edge 114 of the gusset with the gusset, along this edge 108 and between the upper gusset edge 114 and the incline fold line 112 being free of the edge 108, and actually defined by a short cut line designated by reference numeral 116. As will be noted in the drawings, the diagonal fold line 112 results in the formation of a triangular extension 118 immediately therebelow and generally co-planar with and extending from the adjacent flap panel 96, or more particularly the loop handle 102 formed therefrom. The cutline 116, or more particularly the edge length defined thereby is of a length substantially equal to but no greater than the width of the upright legs 120 of the loop handles 102.

The gussets 104 are of a height, upward from the rim-defining fold line 98, slightly greater than the width, between the adjacent flap and flap panel edges 106 and 108.

Noting FIG. 15, upon an inward folding of each of the inner flaps 94, the corresponding gussets 104 to each side thereof fold inwardly about the gusset fold lines 110 and 112. In doing so, the upper edge 114 of the gusset aligns substantially along the inner upright edge 122 of the upright leg 120 of the adjoining loop handle 102 whereby the gusset 104 allows for a free downward folding of the outer panel 100 while at the same time laying against the inner face of the adjoining upright leg of the adjacent loop handle 102 as a stabilizing means for the loop handle 102. So positioned, it will be recognized that the gusset fold line 110 extends along and immediately adjacent that portion of the rim-defining fold line 98 whereat the loop handle upright is joined to the container body. Thus, the opposed loop handles, while rigidified and strengthened at the bases thereof, can inwardly flex or fold toward a common central point for easy handling. The gussets 104 also of course effectively seal the upper defined corners of the closed container.

It is to be recognized that while the single crease lines 36, as illustrated, are preferred in all embodiments, dual crease lines 36', as illustrated in FIG. 7, can be used.

The foregoing described embodiments are illustrative of the invention, and as other embodiments incorporating the inventive features of the invention may occur to those skilled in the art, the disclosed embodiments are not to be considered as a limitation on the scope of the invention.

I claim:

1. A container formed of foldable sheet material and comprising a body having a closed substantially circular base end and a peripheral wall extending upward from said base end to an upper peripheral rim, said rim defining an open mouth, said body having a substantially circular cross-section along the height thereof from said base end to said rim, a first pair of generally parallel inner closure flaps integral with said rim along and projecting Upwardly from diametrically opposed lengths of said rim, said inner flaps being selectively foldable at said rim to a closed position projecting diametrically across said open mouth of said container, a second pair of outer closure flaps at substantially right angles to said inner closure flaps, said outer closure flaps being integral with said rim along and projecting upward from diametrically opposed second lengths thereof, said outer flaps being selectively foldable about said rim to a closed position diametrically across said open mouth and in overlying relation to said inner flaps, and lock means integral with said outer flaps for interlocking said outer flaps in the closed position thereof, said flaps in the closed positions thereof, inwardly biasing the corresponding lengths of rim and corresponding sections of said peripheral wall therebelow into substantially common planes whereby four planes at approximately right angles are defined about said container body, each of said planes merging into said substantially circular base end, said inner and outer flaps each having opposed side edges upwardly extending relative to said rim, said inner and outer flaps alternating about said rim with each side edge spaced from an adjacent side edge of an adjacent flap, and a sealing gusset between each pair of adjacent side edges, each sealing gusset extending upward from said rim and being integral with said adjacent side edges along lower extents thereof, said adjacent side edges having upper extents extending freely above said gusset in opposed generally parallel relation to each other, each gusset being inwardly foldable between said adjacent side edges along first and second fold lines extending upward from a common point on said rim in linear alignment with the side edge of the adjacent inner flap, said first fold line extending from said rim point co-linear with the adjacent inner flap side edge, said second fold line extending at a diagonal from said rim point to the adjacent side of the adjacent outer flap, whereby, each of said gussets, upon an inward folding of the adjoining inner flap, is inwardly folded about said diagonal fold line to lie inward of the adjacent outer flap to define a seal at the juncture between the adjacent inner and outer flaps.

2. The container of claim 1 wherein said gussets, upon an inward folding of said outer flaps, overlying the adjacent inner flaps and underlying the adjacent outer flaps.

3. The container of claim 2 including a handle panel bonded to said body wall below and in alignment with each of said outer flaps, each handle panel including a handle having an upper edge portion foldably joined to the associated handle panel in adjacent spaced relation below said rim, each handle being selectively foldable upward from a first position overlying said container wall parallel thereto, to an upwardly pivoted second position extending above said rim to overlie the closed container.

4. A container formed of foldable sheet material and comprising a body having a closed substantially circular base end and a peripheral wall extending upward from said base end to an upper peripheral rim, said rim defining an open mouth, said body having a substantially circular cross-section along the height thereof from said base end to said rim, a first pair of generally parallel inner closure flaps integral with said rim along and projecting upwardly from diametrically opposed lengths of said rim, said inner flaps being selectively foldable at said rim to a closed position projecting diametrically across said open mouth of said container, a second pair of outer closure flaps at substantially right angles to said inner closure flaps, said outer closure flaps being integral with said rim along and projecting upward from diametrically opposed second lengths thereof, said outer flaps being selectively foldable about said rim to a closed position diametrically across said open mouth and in overlying relation to said inner flaps, lock means integral with said outer flaps for interlocking said outer flaps in the closed position thereof, said flaps in the closed positions thereof, inwardly biasing the corresponding lengths of rim and corresponding sections of said peripheral wall therebelow into substantially common planes whereby four planes at approximately right angles are defined about said container body, each of said planes merging into said substantially circular base end, and a handle panel bonded to said body wall below and in alignment with each of said outer flaps, each handle panel including a handle having an upper edge portion foldably joined to the associated handle panel in adjacent spaced relation below said rim, each handle being selectively foldable upward from a first position overlying said container wall parallel thereto, to an upwardly pivoted second position extending above said rim fold line to overlie the closed container.

5. A container formed of foldable sheet material and comprising a body having a closed substantially circular base end and a peripheral wall extending upward from said base end to an upper peripheral rim, said rim defining an open mouth, said body having a substantially circular cross-section along the height thereof from said base end to said rim, a first pair of generally parallel inner closure flaps integral with said rim along and projecting upwardly from diametrically opposed lengths of said rim, said inner flaps being selectively foldable at said rim to a closed position projecting diametrically across said open mouth of said container, a second pair of outer closure flaps at substantially right angles to said inner closure flaps, said outer closure flaps being integral with said rim along and projecting upward from diametrically opposed second lengths thereof, said outer flaps being selectively foldable about said rim to a closed position diametrically across said open mouth and in overlying relation to said inner flaps, lock means integral with said outer flaps for interlocking said outer flaps in the closed position thereof, said flaps in the closed positions thereof, inwardly biasing the corresponding lengths of rim and corresponding sections of said peripheral wall therebelow into substantially common planes whereby four planes at approximately right angles are defined about said container body, each of said planes merging into said substantially circular base end, each said outer flap being defined from an outer flap panel including one of said outer flaps and a loop handle integral with said rim and extending upward therefrom substantially coplanar with and about the corresponding outer flap, each outer flap being inwardly foldable at said rim relative to and independent of the associated loop handle, whereby said loop handles project Upwardly from the flap-closed mouth of the container, each said loop handle including a pair of upwardly directed legs immediately outward to the opposed sides of the corresponding outer flap, and a bight portion overlying the outer end of said corresponding outer flap, said legs having inner ends integral with said rim, said outer flap panels having opposed side edges upwardly extending relative to said rim and defining outer side edges of the respective loop handles, said inner flaps each having opposed side edges upwardly extending relative to said rim, said inner flaps and outer flap panels alternating about said rim with each inner flap side edge spaced from the adjacent side edge of the adjacent outer flap panel, and a sealing gusset between each pair of adjacent side edges, each sealing gusset extending upward from said rim and being integral with said adjacent side edges along lower extents thereof, said adjacent side edges having upper extents extending freely above said gusset in opposed generally parallel relation to each other, each gusset being inwardly foldable between said adjacent side edges along first and second fold lines extending upward from a common point on said rim in linear alignment with the side edge of the adjacent inner flap, said first fold line extending from said rim point co-linear with the adjacent inner flap side edge, said second fold line extending at a diagonal from said rim point to the adjacent side edge of the adjacent outer flap panel, whereby, each of said gussets, upon an inward folding of the adjoining inner flap, is inwardly folded about said diagonal second fold line to lie inward of and against the loop handle of an adjacent outer flap panel to brace said handle and define a seal at the juncture between the adjacent inner flaps and outer flap panels.

6. The container of claim 5 wherein each of said gussets extends upward beyond the corresponding diagonal second gusset fold line, each of said gussets above the corresponding second gusset fold line being separate from the adjacent outer flap panel by a cutline, each of said gussets, upon a folded positioning thereof inward of and against the adjacent handle, engaging against the adjoining handle leg and terminating short of the adjacent side of the adjoining outer flap to allow for free folding movement of the outer flap.

7. A container formed of foldable sheet material and comprising a body having a closed base end and a peripheral wall extending upward from said base end to an upper peripheral rim, said rim defining an open mouth, first inner closure flaps integral with said rim along and projecting upwardly therefrom, said inner flaps being selectively foldable at said rim to a closed position projecting across said open mouth of said container, second outer closure flaps, said outer closure flaps being integral with said rim along and projecting upward therefrom, said outer flaps being selectively foldable about said rim to a closed position across said open mouth and in overlying relation to said inner flaps, and lock means integral with said outer flaps for interlocking said outer flaps in the closed position thereof, said inner and outer flaps each having opposed side edges upwardly extending relative to said rim, said inner and outer flaps alternating about said rim with each side edge spaced from the adjacent side edge of the adjacent flap, and a sealing gusset between each pair of adjacent side edges, each sealing gusset extending upward from said rim and being integral with said adjacent side edges along lower extents thereof, said adjacent side edges having upper extents extending freely above said gusset in opposed generally parallel relation to each other, each gusset being inwardly foldable between said adjacent side edges along first and second fold lines extending upward from a common point on said rim between said adjacent side edges, each of said gussets, upon an inward folding of the adjoining inner and outer flaps, inwardly folding to lie inward of the adjacent outer flap and define a seal at the juncture between the adjacent inner and outer flaps.

8. The container of claim 7 wherein said common point on said rim from which said first and second fold lines extend is in linear alignment with the side edge of the adjacent inner flap, said first fold line extending from said rim point co-linear with the adjacent inner flap side edge, said second fold line extending at a diagonal from said rim point to the adjacent side of the adjacent outer flap.

9. The container of claim 8 wherein each said outer flap being defined from an outer flap panel including one of said outer flaps and a loop handle integral with said rim and extending upward therefrom substantially coplanar with and about the corresponding outer flap, each outer flap being inwardly foldable at said rim relative to and independent of the associated loop handle, whereby said loop handles project upwardly from the flap-closed mouth of the container.

10. The container of claim 9 wherein each of said gussets extends upward beyond the corresponding diagonal second gusset fold line, each of said gussets above the corresponding second gusset fold line being separate from the adjacent outer flap panel by a cutline, each of said gussets, upon a folded positioning thereof inward of and against the adjacent handle, engaging against the adjoining handle leg and terminating short of the adjacent side of the adjoining outer flap to allow for free folding movement of the outer flap.

11. The container of claim 7 including a handle panel bonded to said body wall below and in alignment with a pair of said outer flaps, each handle panel including a handle having an upper edge portion foldably joined to the associated handle panel in adjacent spaced relation below said rim, each handle being selectively foldable upward from a first position overlying said container wall generally parallel thereto, to an upwardly pivoted second position extending above said rim to overlie the closed container.

12. A container formed of foldable sheet material and comprising a body having a closed base end and a peripheral wall extending upward from said base end to an upper peripheral rim, said rim defining an open mouth, first inner closure flaps integral with said rim along and projecting upwardly therefrom, said inner flaps being selectively foldable at said rim to a closed position projecting across said open mouth of said container, second outer closure flaps, said outer closure flaps being integral with said rim along and projecting upward therefrom, said outer flaps being selectively foldable about said rim to a closed position across said open mouth and in overlying relation to said inner flaps, lock means integral with said outer flaps for interlocking said outer flaps in the closed position thereof, and a handle panel bonded to said body wall below and in alignment with a pair of said outer flaps, each handle panel including a handle having an upper edge portion foldably joined to the associated handle panel in adjacent spaced relation below said rim, each handle being selectively foldable upward from a first position overlying said container wall generally parallel thereto, to an upwardly pivoted second position extending above said rim to overlie the closed container.

* * * * *